US005228151A

United States Patent [19]

Livingston-Capoano

[11] Patent Number: 5,228,151

[45] Date of Patent: Jul. 20, 1993

[54] FOOT SUPPORT FOR SHOWERS AND BATH

[76] Inventor: Barbara D. Livingston-Capoano, P.O. Box 703, Farmingdale, N.J. 07727

[21] Appl. No.: 769,635

[22] Filed: Sep. 30, 1991

[51] Int. Cl.[5] ..... A47K 3/022

[52] U.S. Cl. ..... 4/574.1; 4/571.1

[58] Field of Search ..... 4/571.1, 573.1, 574.1, 4/575.1, 576.1, 605, 611, 621, 622, 47, 572.1, 578.1, 579

[56] References Cited

U.S. PATENT DOCUMENTS

| | | | |
|---|---|---|---|
| D. 190,624 | 6/1961 | Morrison | D23/304 |
| 1,232,223 | 7/1917 | Clarke | 4/574.1 |
| 2,182,532 | 12/1939 | Bentz | 4/574.1 |
| 3,140,496 | 7/1964 | Thompson | 4/576.1 |
| 3,275,283 | 9/1966 | Rauch | 4/574.1 X |
| 3,713,180 | 1/1973 | Martin | 4/574.1 |
| 4,489,448 | 12/1984 | Cairo | 4/574.1 |

FOREIGN PATENT DOCUMENTS

| | | | |
|---|---|---|---|
| 2405599 | 8/1975 | Fed. Rep. of Germany | 4/576.1 |

*Primary Examiner*—William A. Cuchlinski, Jr.
*Assistant Examiner*—W. Morris Worth
*Attorney, Agent, or Firm*—Clifford G. Frayne

[57] ABSTRACT

A foot support apparatus for mounting in a shower stall or shower/bath assembly for supporting the leg of an individual in an elevated relaxed position to facilitate the shaving of the legs, the apparatus having a base member secured to the wall of the shower stall or shower/bath assembly and a foot support member being generally U-shaped in configuration conforming to the human heel and instep arch for support of the individual's leg.

4 Claims, 4 Drawing Sheets

FIG. 10
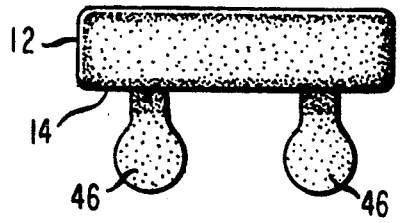
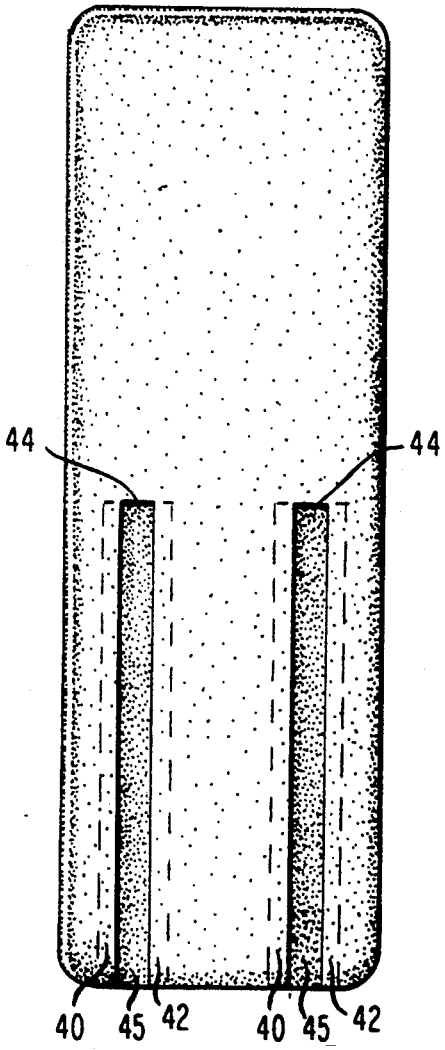
FIG. 8
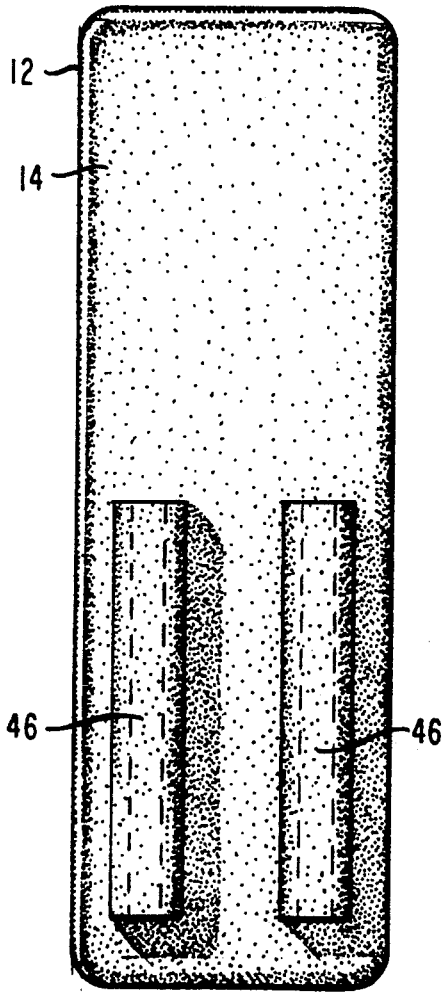
FIG. 9

FOOT SUPPORT FOR SHOWERS AND BATH

FIELD OF INVENTION

This invention relates to a foot support device to be mounted in a shower or bath to facilitate the woman's act of shaving her legs.

BACKGROUND OF THE INVENTION

While showering in a shower stall or combination bath and shower, it is oftentimes difficult for a woman to adequately shave her legs and to avoid nicking or cutting the skin. In order to accomplish the task, the individual must either bend over from the waist in a shower stall or shower/bath combination or in a shower/bath combination rest one's leg in an elevated position along the rim of the tub. Neither position is perfectly satisfactory for accomplishing the task since the smoothest shave is accomplished with the leg extended without any muscular contraction involved.

Attempts have been made in the past to develop foot supports for shower stalls and baths to aid in the cleansing of the lower legs and feet. These apparatus can be found in U.S. Pat. No. 4,489,448 to Cairo, U.S. Pat. No. 3,713,180 to Martin, U.S. Pat. No. 1,232,223 to Clark, U.S. Pat. No. 2,182,532 to Bentz and Design U.S. Pat. No. 190,624 to Morrison.

Clark and Bentz are directed towards a footrest utilized by an individual in a reclining position within the tub. The remainder of the foregoing patents are directed to some type of footrest for resting the ball of the foot in order to aid in cleaning the foot or lower leg. Designs such as Martin and Morrison prevent safety problems within the shower or shower/bath assembly in that they protrude from the wall with sharp edges. Cairo is an actual foot stool which can be placed in the shower stall or shower/bath assembly. All of the foregoing suffer from the shortcoming of not allowing the individual to rest their leg in an extended, substantially horizontal position with muscular relaxation to aid in the shaving of the legs.

Applicant's invention provides for a heel rest secured to the wall of the shower or shower/tub assembly, which has no sharp corners or edges and which allows the individual to rest the heel of their leg in the support and thus allow the individual to shave the leg while the muscles are in a relaxed position.

OBJECTS OF THE INVENTION

It is a principal object of the present invention to provide for a foot support for showers and baths to facilitate the woman's act of shaving her legs.

It is another object of the present invention to provide for a foot support for showers or baths which allows for the woman to support her leg in a substantially horizontal position with the heel of the foot engaging the foot support.

It is a still further object of the present invention to provide for a foot support for showers or baths which has no sharp or angled corners or edges.

It is a still further object of the present invention to provide for a foot support for the shower or bath which is adjustable in height so as to allow the user to support their leg in an extended horizontal position and to allow the muscles of the extended leg to reside in a relaxed mode.

SUMMARY OF THE INVENTION

These and other objects of the present invention are achieved by means of a molded foot support engageable with the heel of the user, the foot support being adjustably secured to the wall of a shower or shower/bath assembly to a height comfortable to the user, the foot support being of molded material having no sharp corners or edges, and being adhesively secured to the wall of the shower or shower/bath assembly.

BRIEF DESCRIPTION OF THE DRAWINGS

These and other objects of the present invention will become more apparent from the following description when taken in conjunction with the accompanying drawings wherein:

FIG. 8 is a rear plan view of a third embodiment of the foot support; and

FIG. 9 is a front plan view of a third embodiment of the foot support.

FIG. 10 is a top plan view of a third embodiment of the foot support.

DETAILED DESCRIPTION OF THE DRAWINGS

Figure 1:
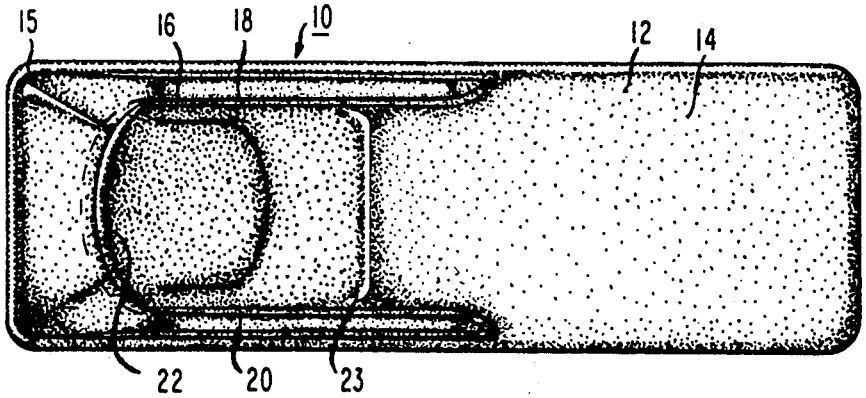
FIG. 1 is a front plan view of the foot support.

With reference to FIG. 1, there is illustrated a front plan view of the foot support 10 for use in shower stalls or shower/bath assemblies. Foot support 10 comprises a base member 12 generally rectangular in shape having a substantially planer surface 14 and having rounded perimeter edges 15. Extending outwardly from planer surface 14 is a foot support stirrup 16. Foot support stirrup 16 is generally U-shaped in configuration having molded rounded sidewalls 18 and 20 and a molded rounded base 22 which is arcuate in shape and designed to conform to the configuration of an individual's heel. A slightly protruding ridge 23 extending between sidewalls 18 and 20 is shaped to engage the arch and instep of the foot.

Figure 2:
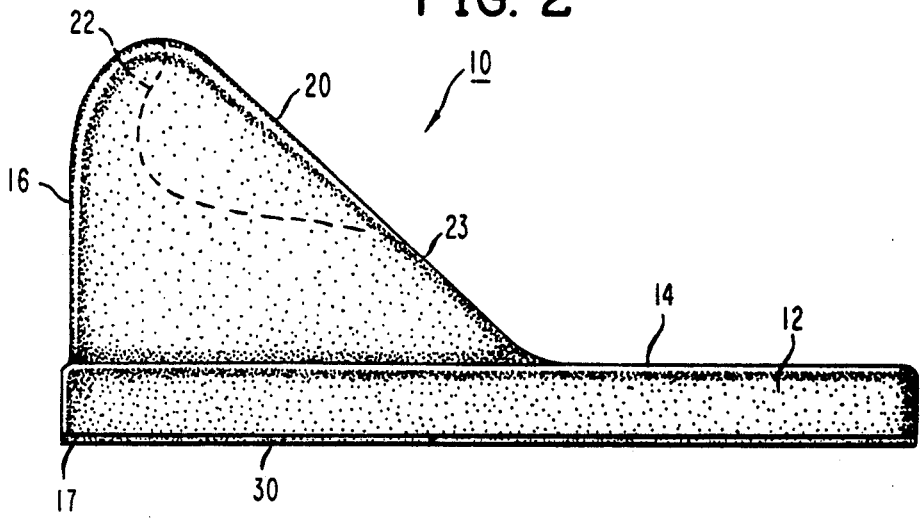
FIG. 2 is a side plan view of the foot support.
Figure 3:
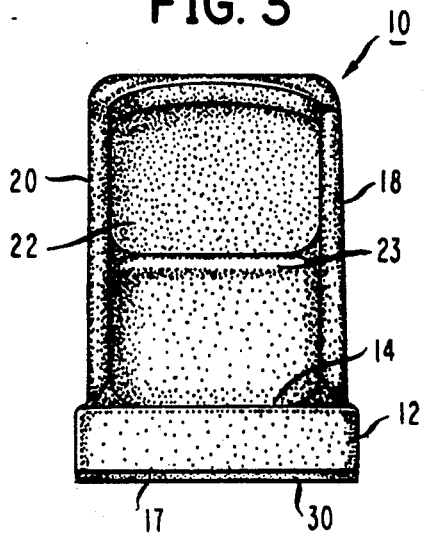
FIG. 3 is a top plan view of the foot support.

A better understanding of the relationship of support stirrup 16 to base 12 can be observed with reference to FIGS. 2 and 3 which are side plans and top views, respectively, of foot support 10. In the preferred embodiment, support stirrup 16 and base member 12 would be of one-piece molded construction. The sidewalls 18 and 20 of stirrup 16 would have rounded edges to decrease the possibility of injuries from bumping into or contacting foot support 10.

Foot support 10 in its preferred embodiment is designed to be secured to the ceramic tile or fiberglass walls of the shower stall or shower/bath assembly. In the embodiment shown in FIGS. 2 and 3, a waterproof adhesive 30 is secured to the rear face 17 of base member 12. The adhesive utilized would preferably be water insoluble and could be secured to rear face 17 of base member 12 in the form of a double stick tape or the like. In this embodiment, the user could establish the comfortable height required in order to utilize the foot support and mark this height with a grease pencil on the wall of the shower stall or shower/bath assembly. The user would then remove the protective tape and position the foot support at this height.

Since support stirrup 16 will be supporting the weight of the user's leg, base member 12 is longitudinally rectangular in shape in order to provide for sufficient surface for adhesive 30 to frictionally engage the wall of the shower stall or shower/bath assembly and prevent the foot support from sliding downwardly under the weight of the user's leg.

Figure 4:
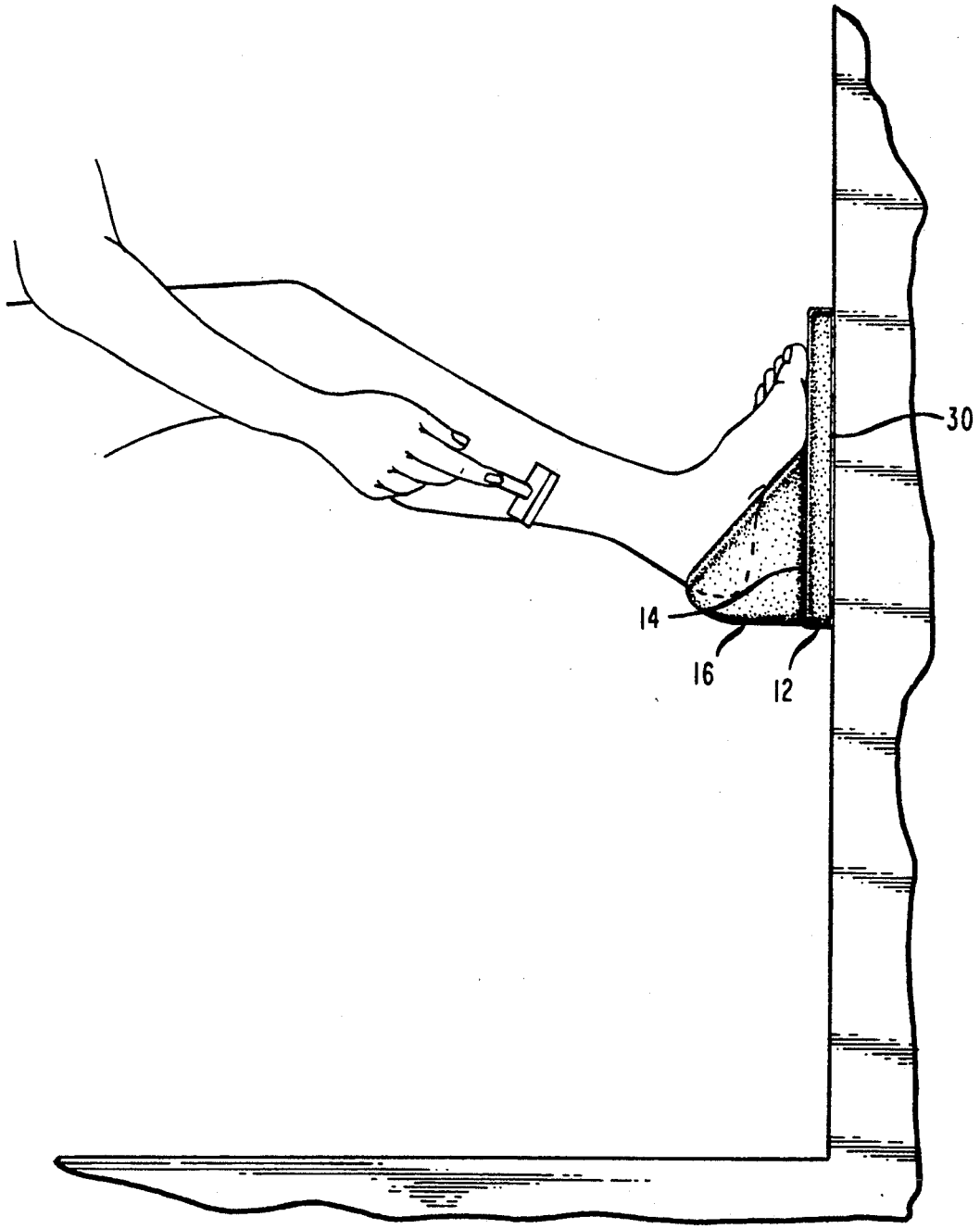
FIG. 4 is a partial perspective view illustrating the use of the foot support.

Referring to FIG. 4, there is illustrated a partial perspective view of the use of the foot support 10. The user would stand in the shower stall or shower/bath assembly on a firm support such as a nonslip shower or bath mat and selectively engage either the right leg or the left leg, with the left heel or the right heel in foot support 10. This would support the leg in a relaxed, elevated position so as to permit the user to shave the selected leg with the muscles of that leg in a substantially relaxed position.

Figure 6:
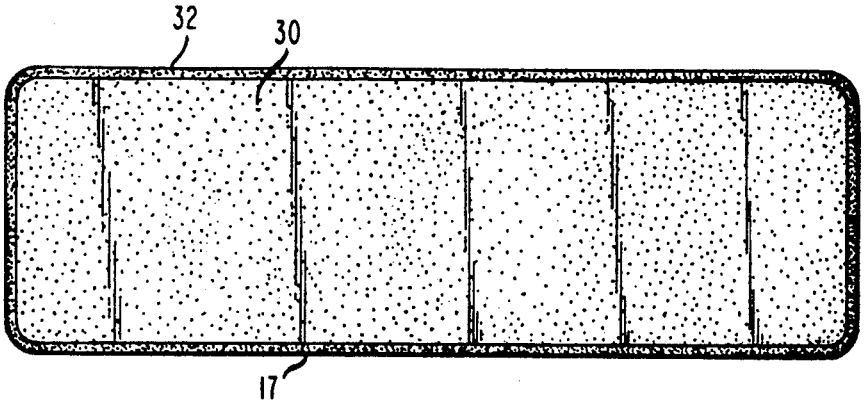
FIG. 6 is a rear plan view of the second embodiment of the foot support.
Figure 5:
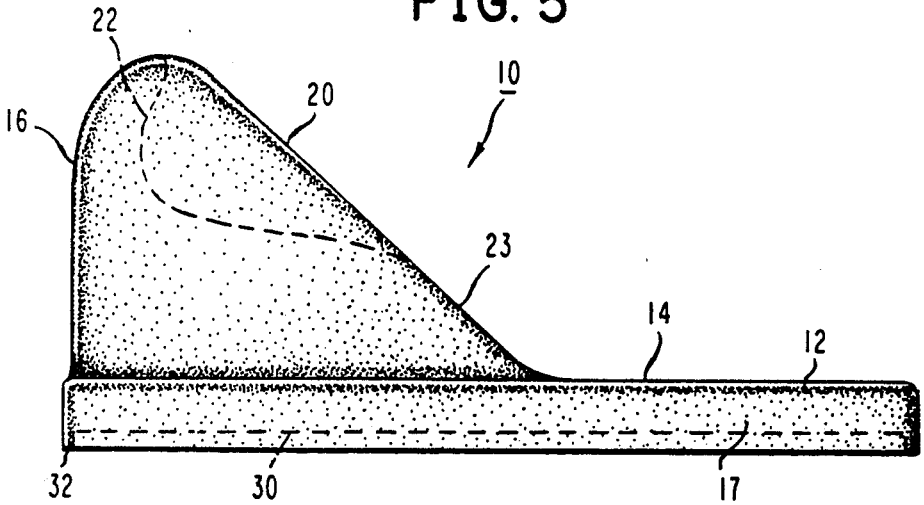
FIG. 5 is a side plan view of a second embodiment of a foot support.
Figure 7:
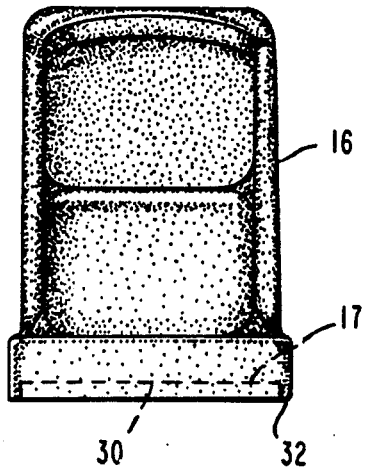
FIG. 7 is a top plan view of the second embodiment of the foot support.

Referring to FIG. 5, 6 and 7, there is illustrated a side, rear and top view of a second embodiment of foot support 10 which discloses a second means for securing foot support 10 to the wall of a shower stall or shower bath. The front face 12 and support stirrup 16 of foot support 10 would be identical to that illustrated in FIGS. 1, 2 and 3. The rear face 17 of base member 12 would have an annular lip 32 about its perimeter. The adhesive 30 would be positioned on rear face 17 to a height substantially identical to the lip 32. In this fashion, the adhesive 30 could be engaged with the wall of the shower stall or shower bath assembly such that lip 32 would be in proximate contact with the surface of the shower stall wall or shower/bath wall. The user, for additional protection, could then caulk the perimeter of foot support 10 where lip 32 engages the wall to provide further waterproof protection to the adhesive and provide an aesthetic appearance with respect to the mounting of the foot support 10.

Being of a one-piece molded construction, foot support 10 could be fashioned in various colors compatible with fashionable colors used in ceramic tiles or in fiberglass enclosures for shower stalls or shower/bath assemblies and thereby not detract from the aesthetics of the shower or bath.

The one-piece molded construction allows for ease of manufacture, however, foot support 10 could be adapted to a third embodiment of two-piece construction which would allow the easy removal of the foot stirrup 16 from base member 12 when not in use.

FIGS. 8, 9 and 10 illustrate the manner of this construction. FIG. 8 is a rear view of foot stirrup member 16. The front, foot engaging surface is identical to that disclosed in the first and second embodiments. The rear surface contains one or more longitudinal channels 40 having an open lower end 42 and a closed top end 44. Each of channels 40 also have a longitudinal slot 45.

FIG. 9 is a front view of base member 12 which is identical to that disclosed in the first and second embodiment with the exception that base member 12 now has positioned on its front surface 14, one or more guide rails 46. Guide rails 46 protrude longitudinally from front surface 14 and have a cross sectional area identical to the cross sectional area of channel 40 in foot stirrup member 16. In this fashion, foot stirrup member 16 is slidably engaged with guide rails 46 by means of channels 40 by positioning channels 40 of foot stirrup member 16 above guide rails 46 on front surface 14 and sliding foot stirrup member 16 downwardly engaging channels 46, the downward movement of foot stirrup 16 ceasing when guide rails 46 engage closed end 44 of channel 40. FIG. 10 is a top plan view of base member 12 illustrating guide rails 46. Each guide rail has a neck portion 48 which cooperates with slot 45 in channel 40 to allow the slidable engagement of foot support stirrup 16 with base member 12.

In this type of embodiment, base member 12 can be positioned on the wall of the shower stall or shower/bath assembly in a manner previously discussed. Foot stirrup member 16 can then be engaged with base member 12 when so desired, and removed when not in use. Again, both members can be separately fashioned of one-piece molded construction in the desired color combinations.

While the invention has been described with reference to the preferred embodiments thereof, it will be appreciated by those of ordinary skill in the art that various changes can be made without departing from the basic spirit and scope of the invention.

I claim:

1. A foot support apparatus adapted for mounting to a wall of a shower stall or shower/bath assembly, said foot support apparatus for supporting a leg of an individual in an elevated, relaxed position, to facilitate shaving of the leg, said apparatus comprising:

a base member, generally rectangular in shape having a first planar side and a second planar side, said first planar side for receipt of a securing means to secure said base member to said wall of said shower stall or said shower/bath assembly;

a foot support member secured to said second planar side of said base member, said foot support member comprising an extended stirrup conforming to the human heel and instep arch, said extending stirrup being generally U-shaped in configuration having rounded edges and extending outwardly from said second side of said base member, said extending stirrup being of one-piece molded construction with said base member, said base member having a longitudinal axis in excess of its lateral axis in order to permit said securing means to secure said base member to said wall of said shower stall or said shower/bath assembly so as to maintain said base member in a secure position supporting said leg of said individual.

2. An apparatus in accordance with claim 1 wherein said securing means comprises a water-resistant adhesive secured to said first side of said base member for engaging said first side of said base member with said wall of said shower stall or said shower/bath assembly.

3. A foot support apparatus in accordance with claim 1 wherein said foot support stirrup and said base member are positioned on said wall of said shower stall or said shower/bath assembly at a predetermined height s as to permit the user to selectively engage said human heel and instep arch in said foot support stirrup so as to support said leg in an elevated, relaxed position.

4. An apparatus in accordance with claim 1 wherein said base member comprises peripheral sidewalls between said first side and said second side, said peripheral sidewalls being in rounded engagement with said second side of said base member, said peripheral sidewalls defining a recessed first side of said base member, said recessed first side of said base member for receipt of said securing means for engaging said base member with said wall of said shower stall or said shower/bath assembly, said peripheral sidwalls proximate said first side of said base member being in proximate contact with said wall of said shower stall or said shower/bath assembly when said base ember is secured thereto, thus permitting a caulking means to be secured about to said sidewalls and said wall in an area of contact to further protect said securing means.

* * * * *